US007213551B2

(12) United States Patent
Asada et al.

(10) Patent No.: US 7,213,551 B2
(45) Date of Patent: May 8, 2007

(54) VARIABLE VALVE OPERATING DEVICE

(75) Inventors: Toshiaki Asada, Mishima (JP); Shuichi Ezaki, Susono (JP); Manabu Tateno, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/579,296

(22) PCT Filed: Aug. 30, 2005

(86) PCT No.: PCT/JP2005/016186

§ 371 (c)(1),
(2), (4) Date: May 15, 2006

(87) PCT Pub. No.: WO2006/025566

PCT Pub. Date: Mar. 9, 2006

(65) Prior Publication Data

US 2007/0062472 A1 Mar. 22, 2007

(30) Foreign Application Priority Data

Aug. 31, 2004 (JP) ..... 2004-252560

(51) Int. Cl.
*F01L 1/34* (2006.01)

(52) U.S. Cl. ..... 123/90.16; 123/90.39; 123/90.44

(58) Field of Classification Search ..... 123/90.16, 123/90.2, 90.39, 90.44, 90.41; 74/559, 567, 74/569

See application file for complete search history.

(56) References Cited

U.S. PATENT DOCUMENTS 6,357,405 B1 3/2002 Tsuji et al.
6,968,819 B2 * 11/2005 Fujii et al. ..... 123/90.44

FOREIGN PATENT DOCUMENTS

| | | |
|---|---|---|
| JP | A-06-017628 | 1/1994 |
| JP | A-06-074011 | 3/1994 |
| JP | A-07-063023 | 3/1995 |
| JP | A-11-036833 | 2/1999 |
| JP | A-2001-164911 | 6/2001 |
| JP | A-2002-371816 | 12/2002 |
| JP | A-2003-106123 | 4/2003 |
| JP | A-2003-239712 | 8/2003 |
| JP | A-2005-194986 | 7/2005 |

* cited by examiner

*Primary Examiner*—Ching Chang
(74) *Attorney, Agent, or Firm*—Oliff & Berridge, PLC

(57) ABSTRACT

The present invention provides a compact variable valve operating device that is capable of mechanically changing the operating characteristic of a valve. The rotation motion of a camshaft is input to the valve via a swing member. A slide surface is formed on the swing member. Intermediate members are positioned in contact with both the slide surface and drive cam surface. A support member for supporting the intermediate members is mounted on a control member. The control member can rotate in relation to the camshaft and is interlocked with a control shaft via rotation interlock mechanisms. When the control member rotates in coordination with the rotation of the control shaft, the intermediate members move along the drive cam surface and slide surface. The operating characteristic of the valve then changes in coordination with a positional change of the intermediate members.

8 Claims, 7 Drawing Sheets

VARIABLE VALVE OPERATING DEVICE

TECHNICAL FIELD

The present invention relates to a variable valve operating device for an internal combustion engine, and more particularly to a variable valve operating device that is capable of mechanically changing the operating characteristic of a valve.

BACKGROUND ART

A conventionally known variable valve operating device that is disclosed, for instance, by Japanese Patent Laid-open No. 2003-239712 mechanically changes the valve lift amount and valve timing in accordance with the operating state of an engine. For the variable valve operating device described in Japanese Patent Laid-open No. 2003-239712, a control arm is fastened to a control shaft that is positioned in parallel with a camshaft, and one end of a follower is mounted on the control arm and allowed to swing freely. Further, a swing cam is mounted on the control shaft and allowed to swing freely. A rocker arm is pressed against the surface of the swing cam. A first roller and a second roller are concentrically mounted on the follower so that these rollers can rotate independently of each other. The first roller is in contact with a valve cam on the camshaft, and the second roller is in contact with a contact surface that is formed on the side away from the cam surface of the swing cam.

When the control arm rotation position changes due to control shaft rotation while the above configuration is employed, the follower becomes displaced so as to change the distance between the control shaft and the contact between the swing cam and second roller. Consequently, the valve lift amount changes. Further, the circumferential position of the valve cam, which comes into contact with the first roller, changes in the same rotation position of the camshaft. This causes the valve timing to change also. In other words, the variable valve operating device described in Japanese Patent Laid-open No. 2003-239712 can simultaneously change the valve lift amount and valve timing when the rotation position of the control shaft is controlled by a motor.

Including the above-mentioned document, the applicant is aware of the following documents as a related art of the present invention.

[Patent Document 1]
Japanese Patent Laid-open No. 2003-239712
[Patent Document 2]
Japanese Patent Laid-open No. Hei7-63023
[Patent Document 3]
Japanese Patent Laid-open No. Hei6-74011
[Patent Document 4]
Japanese Patent Laid-open No. Hei6-17628
[Patent Document 5]
Japanese Patent Laid-open No. Hei11-36833

DISCLOSURE OF THE INVENTION

In marked contrast to a normal valve apparatus that uses a cam to drive a rocker arm, the variable valve operating device described in Japanese Patent Laid-open No. 2003-239712 makes it necessary to install a mechanism comprising a plurality of members such as the control shaft, swing cam, control arm, follower, and roller within a cylinder head. In reality, however, the cylinder head has a limited amount of extra space. Therefore, when the complicated mechanism described above is to be installed in the cylinder head, it is necessary to change the positional relationship among existing members or enlarge the cylinder head.

The present invention has been made to solve the above problem. It is an object of the present invention to provide a variable valve operating device that is compact and capable of mechanically changing the operating characteristic of a valve.

The above object is achieved by a variable valve operating device according to a first aspect of the present invention. The variable valve operating device mechanically changes the operating characteristic of a valve in relation to the rotation of a camshaft. The variable valve operating device includes a drive cam installed over the camshaft and a control shaft positioned in parallel with the camshaft. The control shaft is capable of changing the rotation position continuously or stepwise. The variable valve operating device also includes a swing member that is installed over the control shaft and allowed to swing around the control shaft. A swing cam surface is formed on the swing member, comes into contact with a valve support member, which supports the valve, and presses the valve in a lifting direction. A slide surface is also formed on the swing member so as to face the drive cam. An intermediate member is positioned between the drive cam and the swing member and comes into contact with both the slide surface and a cam surface of the drive cam. A control member is installed over the camshaft and allowed to rotate. A support member is mounted on the control member to support the intermediate member so that the intermediate member can be moved along a predetermined path in relation to the control member. Further, the variable valve operating device includes a rotation interlock mechanism. The rotation interlock mechanism interlocks the rotation of the control member around the camshaft with the rotation of the control shaft.

According to the first aspect of the present invention, the rotation motion of the camshaft is transmitted from the cam surface of the drive cam to the slide surface of the swing member via the intermediate member and then converted to the swing motion of the swing member. The swing motion of the swing member is transmitted from the swing cam surface to the valve support member and then converted to the lift motion of the valve. In other words, the rotation motion of the camshaft is converted to the lift motion of the valve via the intermediate member and the swing member.

When the rotation position of the control shaft is changed, the rotation of the control shaft is transmitted to the control member via the rotation interlock mechanism so that the control member rotates around the camshaft. The intermediate member is supported by the control member via the support member. Therefore, when the control member rotates around the camshaft, the intermediate member also turns around the camshaft so as to change the intermediate member position on the drive cam surface and the intermediate member position on the slide surface. When the intermediate member position on the slide surface changes, the swing angle and initial swing position of the swing member change, thereby causing a change in the valve lift amount. Further, when the intermediate member position on the drive cam surface changes, the swing timing of the swing member changes in relation to the phase of the camshaft, thereby causing a change in the valve timing.

As described above, the first aspect of the present invention can mechanically change the operating characteristic by controlling the rotation position of the control shaft. Further, the first aspect of the present invention ensures that the support member, which supports the intermediate member, and the control member are positioned around the existing camshaft. Therefore, the resulting apparatus is compact.

According to a second aspect of the present invention, in the variable valve operating device according to the first aspect of the present invention, the support member may be formed as a guide that is integral with the control member.

According to the second aspect of the present invention, the support member and control member are integrated into the guide. Therefore, only the swing member and intermediate member move to lift the valve. This makes it possible to avoid an increase in the inertial mass of the entire movable section.

According to a third aspect of the present invention, in the variable valve operating device according to the second aspect of the present invention, the guide may be formed outward from the center of the camshaft.

According to the third aspect of the present invention, the guide is formulated outward from the center of the camshaft. This causes the intermediate member to reciprocate substantially in the radial direction of the camshaft in accordance with the rotation of the drive cam. Consequently, the intermediate member is inhibited from making an unnecessary move on the slide surface. This makes it possible to minimize the loss in the driving force transmission from the drive cam to the swing member.

According to a fourth aspect of the present invention, in the variable valve operating device according to the first aspect of the present invention, the support member may be configured as a link member for linking the control member to the intermediate member, mounted on the control member, and allowed to swing around a position away from the center of the camshaft.

According to the fourth aspect of the present invention, the link member couples the intermediate member to the control member. Therefore, the intermediate member can be properly positioned in relation to the control member.

According to a fifth aspect of the present invention, in the variable valve operating device according to any one of the first to fourth aspects of the present invention, the rotation interlock mechanism may comprise a first gear, which is installed over the control shaft to rotate together with the control shaft, and a second gear, which is installed over the control member to mesh with the first gear.

According to the fifth aspect of the present invention, a gear mechanism, which comprises the first and second gears, is used as the rotation interlock mechanism so that the rotation of the control member is accurately interlocked with the rotation of the control shaft. As a result, the rotation position of the control member can be accurately controlled.

According to a sixth aspect of the present invention, in the variable valve operating device according to any one of the first to fifth aspects of the present invention, the rotation interlock mechanism may be a speed reducing mechanism for decelerating the rotation of the control shaft with gears and transmitting the decelerated rotation to the control member.

According to the sixth aspect of the present invention, the gear-based speed reducing mechanism is used as the rotation interlock mechanism to inhibit an inverse torque input from the control member to the control shaft. Due to reactive force that the intermediate member receives from the slide surface, the torque for rotation around the camshaft is exerted on the control member. This torque varies in accordance with the rotation of the drive cam. When a torque change is input to the control shaft, the rotation position of the control shaft changes. However, the sixth aspect of the present invention uses the speed reducing mechanism to inhibit an inverse torque input from the control member to the control shaft as mentioned above, thereby avoiding a change in the rotation position of the control shaft.

According to a seventh aspect of the present invention, in the variable valve operating device according to any one of the first to sixth aspects of the present invention, the swing cam surface may include a nonoperating surface, which is formed at a fixed distance from the swing center of the swing member, and an operating surface, which is contiguous with the nonoperating surface and whose distance to the swing center gradually increases with an increase in the distance to the nonoperating surface. The valve is lifted when the swing member swings so that the contact position at which the swing cam surface contacts the valve support member moves from the nonoperating surface to the operating surface.

According to the seventh aspect of the present invention, the valve lift amount is determined by the position reached on the operating surface of the valve support member, and the valve working angle is determined by the period during which the valve support member is positioned on the operating surface. When the swing angle and initial swing position of the swing member change as mentioned earlier, the position reached on the operating surface of the valve support member changes. This also changes the period during which the valve support member is positioned on the operating surface. Consequently, the seventh aspect of the present invention makes it possible to change the working angle and lift amount in a coordinated manner.

According to a eighth aspect of the present invention, in the variable valve operating device according to any one of the first to seventh aspects of the present invention, the intermediate member may include a first roller, which comes into contact with the cam surface of the drive cam; a second roller, which is concentric with the first roller and comes into contact with the slide surface; and a connecting shaft, which connects the first roller to the second roller so as to permit the first and second rollers to rotate independently of each other.

According to the eighth aspect of the present invention, the intermediate member includes two rollers, first and second rollers, that can rotate independently of each other. The first roller comes into contact with the surface of the drive cam, and the second roller comes into contact with the slide surface. Therefore, it is possible to reduce the friction loss in the driving force transmission from the camshaft to the valve and prevent the fuel efficiency from deteriorating. Further, the two rollers are installed over the same axis. This makes it possible to render the intermediate member compact and minimize the distance between the cam surface and slide surface of the drive cam. As a result, the variable valve operating device can be rendered compact.

BEST MODE FOR CARRYING OUT THE INVENTION

First Embodiment

A first embodiment of the present invention will now be described with reference to FIGS. 1 to 5.

[Configuration of a Variable Valve Operating Device According to the First Embodiment]

Figure 1:
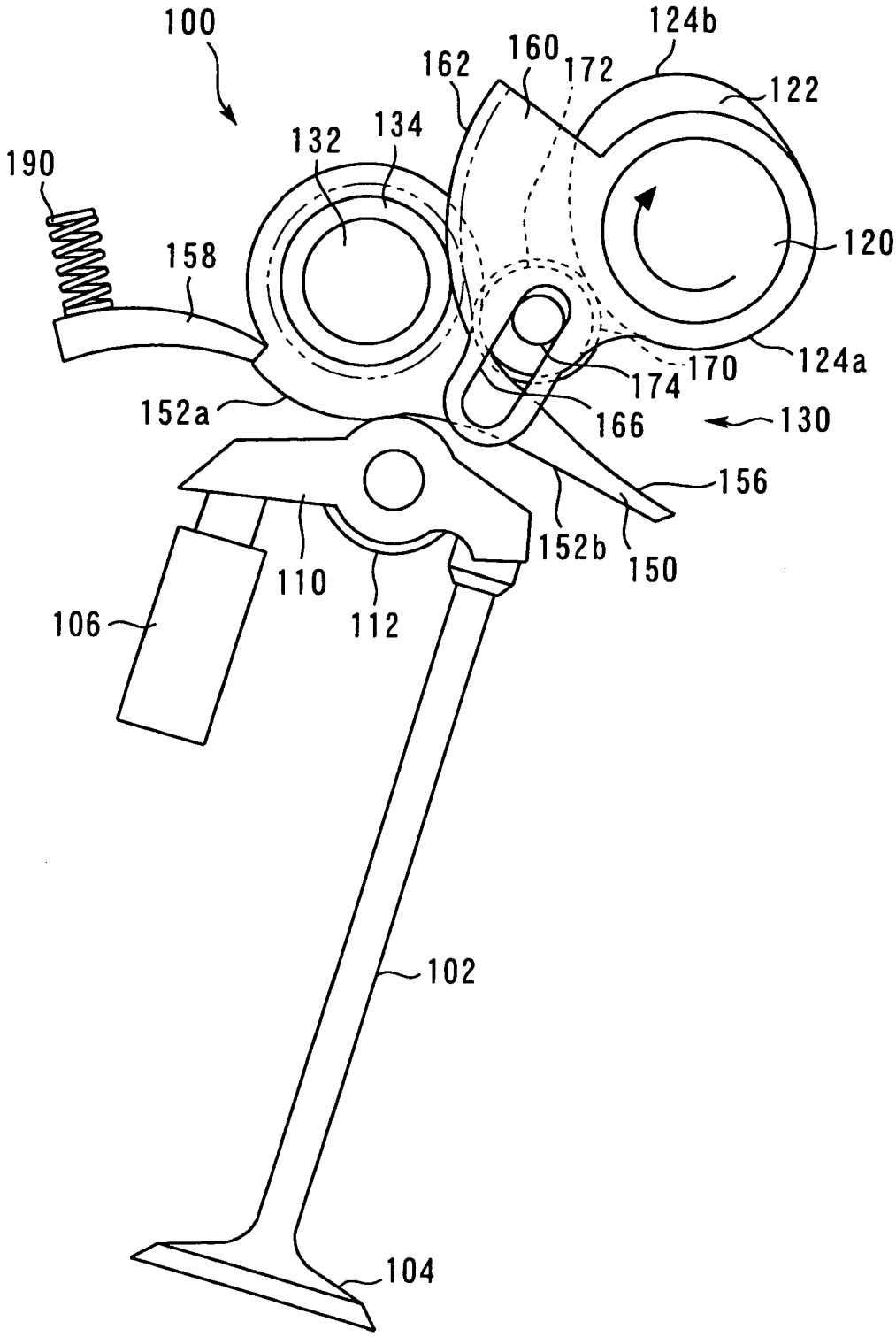
FIG. 1 is a side elevational view showing the configuration of a variable valve operating device according to the first embodiment of the present invention.

FIG. 1 is a side view illustrating the configuration of a variable valve operating device 100 according to the first embodiment of the present invention. The variable valve operating device 100 includes a rocker arm type mechanical valve mechanism. A drive cam 122, which is installed over a cam shaft 120, coverts the rotation motion of the camshaft 120 to the swing motion of a rocker arm (valve support member) 110 and to the vertical lift motion of a valve 104, which is supported by the rocker arm 110. The drive cam 122 has two cam surfaces 124*a*, 124*b*, which have different profiles. One cam surface, nonoperating surface 124*a*, is formed so that the distance from the center of the camshaft 120 is fixed in the rotation direction. The other cam surface, operating surface 124*b*, is formed so that the distance from the center of the camshaft 120 gradually increases and then gradually decreases after the apex in the rotation direction. In this document, the term "drive cam surface 124" is used when the nonoperating surface 124*a* and operating surface 124*b* are not distinguished from each other.

In the variable valve operating device 100, the drive cam 122 does not directly drive the rocker arm 110. An adjustment mechanism 130 is positioned between the drive cam 122 and rocker arm 110 to interlock the swing motion of the rocker arm 110 with the rotation motion of the drive cam 122. The variable valve operating device 100 can continuously change the coordination between the rotation motion of the drive cam 122 and the swing motion of the rocker arm 110 by exercising variable control over the adjustment mechanism 130. This makes it possible to continuously change the lift amount and valve timing of the valve 104 by changing the swing amount and swing timing of the rocker arm 110.

As described below, the adjustment mechanism 130 mainly comprises a control shaft 132, a swing cam arm (swing member) 150, a control arm (control member) 160, a first roller 170, a second roller 172, and a connecting shaft 174, which connects the first roller 170 to the second roller 172. The control shaft 132 is parallel to the camshaft 120. The position of the control shaft 132 relative to the camshaft 120 is set downstream in the rotation direction of the camshaft 120 from the rocker arm 110. A first gear 134, which is concentric with the control shaft 132, is positioned on the outer circumferential surface of the control shaft 132 and fastened to the control shaft 132. Further, an actuator (e.g., motor), which is not shown, is connected to the control shaft 132. An ECU for an internal combustion engine can control the actuator to adjust the rotation position of the control shaft 132.

The swing cam arm 150 is supported by the control shaft 132 and allowed to swing. The leading end of the swing cam arm 150 is positioned upstream in the rotation direction of the drive cam 122. A slide surface 156 is formed on the side opposite the drive cam 122 for the swing cam arm 150. The slide surface 156 comes into contact with the second roller 172, which will be described later. The slide surface 156 is curved leniently toward the drive cam 122 and formed so that the distance to the cam base circle (nonoperating surface 124*a*) for the drive cam 122 increases with an increase in the distance from the center of the control shaft 132, which is the center of swinging.

Meanwhile, a swing cam surface 152 (152*a*, 152*b*) is formed on the side opposite the slide surface 156 of the swing cam arm 150. The swing cam surface 152 is a cam surface whose cam center coincides with the swing center of the swing cam arm 150, and composed of a nonoperating surface 152*a* and an operating surface 152*b*, which have different profiles. The nonoperating surface 152*a* is a circumferential surface of the cam base circle and formed at a fixed distance from the center of the control shaft 132. The other surface, which is the operating surface 152*b*, is positioned toward the leading end of the swing cam arm 150 as viewed from the nonoperating surface 152*a*, connected smoothly and contiguously to the nonoperating surface 152*a*, and formed so that the distance from the center of the control shaft 132 (that is, the cam height) gradually increases with a decrease in the distance to the leading end of the swing cam arm 150. In this document, the term "swing cam surface 152" is used when the nonoperating surface 152*a* and operating surface 152*b* are not distinguished from each other.

The variable valve operating device 100 employs a one-cam, two-valve drive structure in which one drive cam 122 drives two valves 104. Therefore, the swing cam arm 150 is positioned on both sides of the drive cam 122 (FIG. 1 shows only the front swing cam arm 150). The rocker arm 110 is provided for each swing cam arm 150. The swing cam surface 152 is in contact with a rocker roller 112 for the rocker arm 110. The rocker roller 112 is mounted on the middle of the rocker arm 110 and allowed to rotate freely. One end of the rocker arm 110 is provided with a valve shaft 102, which supports the valve 104. The other end of the rocker arm 110 is supported by a hydraulic lash adjuster 106 and allowed to turn freely. A valve spring (not shown) presses the valve shaft 102 in the closing direction, that is, in the direction of pushing up the rocker arm 110. The rocker arm 110 is supported by the valve shaft 102, which is pressed by the valve spring. The hydraulic lash adjuster 106 presses the rocker roller 112 against the swing cam surface 152.

The swing cam arm 150 is provided with a spring seat 158 for engagement with a lost motion spring 190. The spring seat 158 is positioned behind the nonoperating surface 152*a* and extended in a direction opposite the extension direction of the swing cam arm 150. The lost motion spring 190 is a compression spring. Its remaining end is secured by a stationary member (not shown). The spring force that the lost motion spring 190 applies to the spring seat 158 presses the swing cam arm 150 to rotate it toward the slide surface 156.

The control arm 160 is supported by the camshaft 120 and allowed to rotate. The control arm 160 is provided with a second gear 162, which is wedge-shaped and formed around the rotation center of the control arm 160, that is, along an arc concentric with the camshaft 120. The position of the control arm 160 on the camshaft 120 is adjusted so that the second gear 162 is in the same plane as the first gear 134. Further, the rotation phase of the control arm 160 is adjusted so that the second gear 162 faces the first gear 134. The second gear 162 meshes with the first gear 134, and the rotation of the control shaft 132 is input to the control arm 160 via the first gear 134 and second gear 162. In other words, the first gear 134 and second gear 162 constitute an interlock mechanism that interlocks the rotation of the control arm 160 with that of the control shaft 132. Further, the second gear 162 has a larger diameter than the first gear 134 has. Therefore, the first gear 134 and second gear 162 also constitute a speed reducing mechanism that decelerates the rotation of the control shaft 132 and transmits the decelerated rotation to the control arm 160.

The control arm 160 is provided on both sides of the drive cam 122 (FIG. 1 shows only the front control arm 160). As is the case with the control arm 160, the first gear 134 is provided on the outside of both the right- and left-hand swing cam arms 150, and engaged with the second gear 162 of the associated control arm 160.

The control arm 160 is provided with a guide 166, which is integral with the control arm 160. This guide 166 is extended outward from the center of the camshaft 120, that is, extended substantially in the radial direction of the camshaft 120. The approximate rotation position of the control arm 160 is adjusted in relation to the camshaft 120 so that the guide 166 is substantially perpendicular to the slide surface 156 of the swing cam arm 150. As mentioned earlier, the control arm 160 is provided on both sides of the drive cam 122. The guide 166 is formed for each of the right- and left-hand control arms 160. The connecting shaft 174 is passed through the right- and left-hand guides 166. The connecting shaft 174 can move along the guides 166. The connecting shaft 174 supports one first roller 170 and two second rollers 172 in such a manner that the rollers can freely rotate. The two second rollers 172 are positioned on both sides of the first roller 170 (FIG. 1 shows only the front second roller 172). The first and second rollers 170, 172 are positioned between the drive cam surface 124 and slide surface 156. The first roller 170 is in contact with the drive cam surface 124. The second rollers 172 are in contact with the slide surface 156 of each swing cam arm 150. Due to the force that the swing cam arm 150 receives from the lost motion spring 190, the slide surface 156 pushes up the second rollers 172. The first roller 170, which is concentric and integral with the second rollers 172, is pressed against the drive cam surface 124.

[Operations Performed by the Variable Valve Operating Device According to the First Embodiment]

Figure 3:
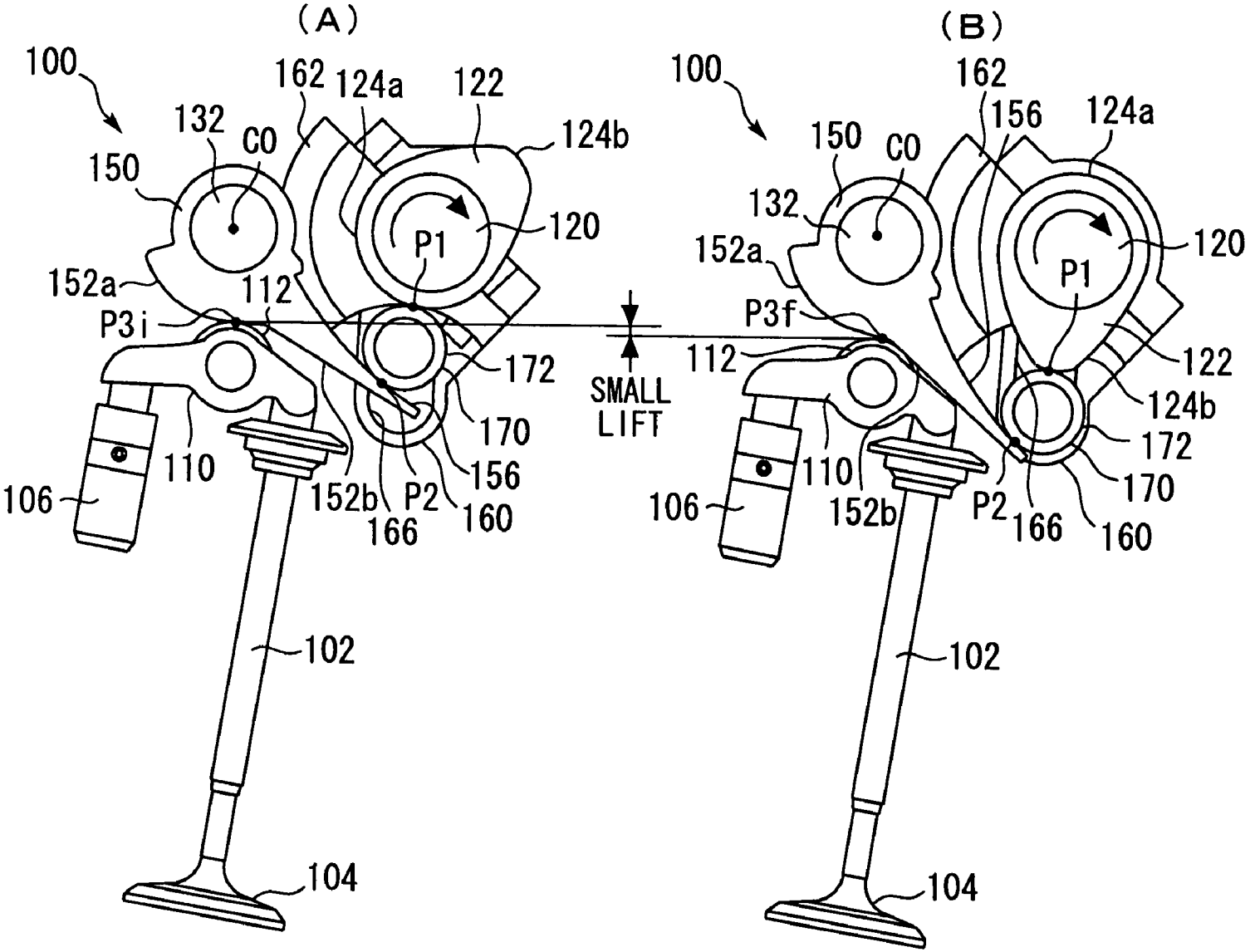
FIG. 3 illustrates a small lift operation performed by the variable valve operating device according to the first embodiment of the present invention, in the figure, (A) shows a valve open condition and (B) shows valve closed condition.
Figure 4:
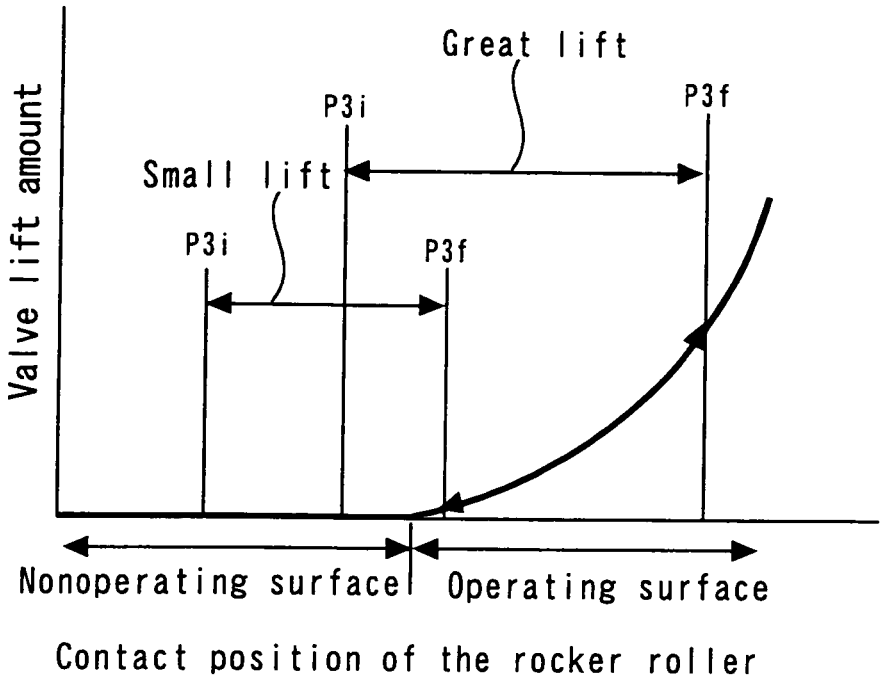
FIG. 4 is a graph showing the relationship between the contact position of the rocker roller onto the swing cam surface and the valve lift amount in the variable valve operating device according to the first embodiment of the present invention.

The operations performed by the variable valve operating device 100 will now be described with reference to FIGS. 2 to 4. To clarify the motions of the rollers 170, 172, FIGS. 2 and 3 exclude the front control arm 160 and first gear 134.

(1) Valve Lift Operation Performed by the Variable Valve Operating Device

First of all, the lift operation performed by the variable valve operating device 100 will be described with reference to FIG. 2. FIG. 2(A) shows the status of the variable valve operating device 100 that prevails when the valve 104 is closed in a valve lift operation sequence. FIG. 2(B) shows the status of the variable valve operating device 100 that prevails when the valve 104 is open in the valve lift operation sequence.

In the variable valve operating device 100, the rotation motion of the drive cam 122 is first input to the first roller 170, which comes into contact with the drive cam surface 124. The first roller 170 and the second rollers 172, which are concentric and integral with the first roller 170, reciprocate along the guide 166. In this instance, the control arm 160 can freely rotate with respect to the camshaft 120, and the control shaft 132 inhibits the rotation of the control arm 160 via the first gear 134 (see FIG. 1) and second gear 162. Therefore, the control arm 160 remains stationary in a fixed posture without regard to the rotation of the drive cam 122. The reciprocating motions of the rollers 170, 172 along the guide 166 are input to the slide surface 156 of the swing cam arm 150, which supports the second rollers 172. Since the force of the lost motion spring (not shown) constantly presses the slide surface 156 against the second rollers 172, the swing cam arm 150 swings around the control shaft 132 in accordance with the rotation of the drive cam 122.

Figure 2:
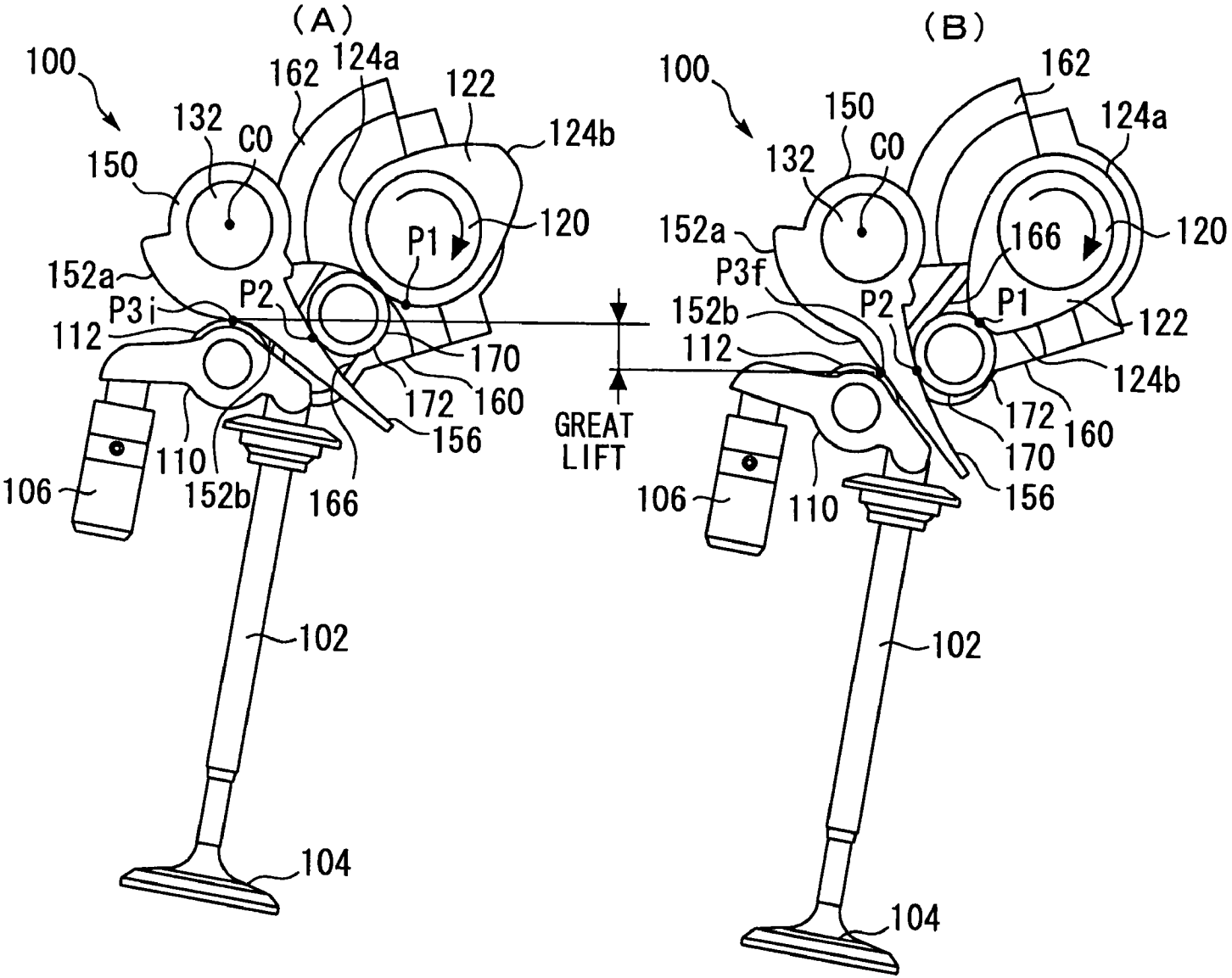
FIG. 2 illustrates a great lift operation performed by the variable valve operating device according to the first embodiment of the present invention, in the figure, (A) shows a valve open condition and (B) shows valve closed condition.

More specifically, when the camshaft 120 rotates in the state shown in FIG. 2(A), the contact position P1 at which the first roller 170 contacts the drive cam surface 124 changes from the nonoperating surface 124*a* to the operating surface 124*b* as indicated in FIG. 2(B). Relatively, the first roller 170 is pushed downward by the drive cam 122. Then, the first roller 170 moves together with the second rollers 172, which are concentric and integral with the first roller 170, along the locus defined by the guide 166. The second rollers 172 then push down the slide surface 156 of the swing cam arm 150. Consequently, the swing cam arm 150 turns clockwise around the control shaft 132 as indicated in FIG. 2. When the camshaft 120 further rotates until the contact position P1 at which the first roller 170 contacts the drive cam surface 124 passes the apex of the operating surface 124*b*, the force generated by the lost motion spring and valve spring causes the swing cam arm 150 to turn counterclockwise around the control shaft 132 as indicated in FIG. 2.

When the swing cam arm 150 turns around the control shaft 132 as described above, the contact position P3 at which the rocker roller 112 contacts the swing cam surface 152 changes. In FIG. 2, the contact positions at which the rocker roller 112 contacts the swing cam surface 152 are designated P3*i* and P3*f*. This is to distinguish between an initial contact position P3*i* and a final contact position P3*f*, which will be described later. In this document, the term "contact position P3" is simply used to represent the contact position at which the rocker roller 112 contacts the swing cam surface 152.

When the rocker roller 112 is in contact with the nonoperating surface 152*a* as indicated in FIG. 2(A), the distance between the nonoperating surface 152*a* and the center of the control shaft 132 is fixed. Therefore, the position of the rocker roller 112 within the space remains unchanged without regard to the contact position. Consequently, the rocker arm 110 does not swing so that the valve 104 is maintained at a fixed position. The positional relationship among the components of the variable valve operating device 100 is adjusted so as to close the valve 104 when the rocker roller 112 is in contact with the nonoperating surface 152*a*.

When the contact position P3 at which the rocker roller 112 contacts the swing cam surface 152 changes from the nonoperating surface 152*a* to the operating surface 152*b* as indicated in FIG. 2(B), the rocker arm 110 is pushed downward in accordance with the distance between the operating surface 152*b* and the center of the control shaft 132. This causes the rocker arm 110 to swing clockwise around a point that is supported by the hydraulic lash adjuster 106. The valve 104 is then pushed downward and opened by the rocker arm 110.

(2) Valve Lift Amount Change Operation Performed by the Variable Valve Operating Device The valve lift amount change operation performed by the variable valve operating device 100 will now be described with reference to FIGS. 2 to 5. FIG. 3 illustrates an operation in which the variable valve operating device 100 gives a small lift to the valve 104. Meanwhile, FIG. 2 illustrates an operation in which the variable valve operating device 100 gives a great lift to the valve 104. FIGS. 2(A) and 3(A) show the status of the variable valve operating device 100 that prevails when the valve 104 is closed in a lift operation sequence. FIGS. 2(B) and 3(B) show the status of the variable valve operating device 100 that prevails when the valve 104 is open in the valve lift operation sequence.

When the valve lift amount is to be changed from the valve lift amount shown in FIG. 2(B) to the valve lift amount shown in FIG. 3(B), the control shaft 132, which is in the state shown in FIG. 2(A), is rotated in the same direction as that of the rotation of the camshaft 120 (rotated clockwise as viewed in the figures), and the control arm 160 is rotated to the rotation position shown in FIG. 3(A). The rotation amount of the control arm 160 is determined by the rotation amount of the control shaft 132 and the gear ratio between the first gear 134 (see FIG. 1) and second gear 162. Both rollers 170, 172 are connected to the control arm 160 by means of a control link 164. Therefore, when the control arm 160 rotates, the first roller 170 moves in a direction opposite the rotation direction of the camshaft 120 along the drive cam surface 124, whereas the second rollers 172 move away from the control shaft 132 along the slide surface 156.

When the second rollers 172 move away from the control shaft 132, the distance between the swing center CO of the swing cam arm 150 and the contact position P2 at which the second rollers 172 contact the slide surface 156 increases, thereby decreasing the swing angle of the swing cam arm 150. The reason is that the swing angle of the swing cam arm 150 is in inverse proportion to the distance between the swing center CO and the contact position P2, which is an oscillation input point. As indicated in FIGS. 2(B) and 3(B), the lift of the valve 104 is maximized when the contact position P1 at which the first roller 170 contacts the drive cam surface 124 is at the apex of the operating surface 124*b*, and the valve lift amount of the valve 104 is determined by the contact position P3*f* at which the rocker roller 112 contacts the swing cam surface 152 when the valve lift is maximized (hereinafter referred to as the final contact position). FIG. 4 illustrates the relationship between the valve lift and the position of the rocker roller 112 on the swing cam surface 152. As indicated in FIG. 4, the final contact position P3*f* is determined by the aforementioned swing angle of the swing cam arm 150 and the contact position P3*i* at which the rocker roller 112 contacts the swing cam surface 152 as indicated in FIGS. 2(A) and 3(A) (hereinafter referred to as the initial contact position).

In the variable valve operating device 100 according to the present embodiment, the slide surface 156 is formed so that the distance to the cam base circle (nonoperating surface 124*a*) of the drive cam 122 increases with an increase in the distance to the swing center. Therefore, when the aforementioned contact position P2 moves away from the swing center CO of the swing cam arm 150, the swing cam arm 150 inclines in such a direction that the slide surface 156 approaches the drive cam surface 124. The swing cam arm 150 then turns counterclockwise around the control shaft 132 as viewed in the figures. This causes the initial contact position P3*i* of the rocker roller 112 on the swing cam surface 152 to move away from the operating surface 152*b* as indicated in FIG. 3(A).

When the control shaft 132 rotates in the same direction as that of the camshaft 120, the swing angle of the swing cam arm 150 decreases and the initial contact position P3*i* moves away from the operating surface 152*b*. Consequently, the final contact position P3*f* that the rocker roller 112 can reach moves toward the nonoperating surface 152*a* as indicated in FIG. 4, thereby decreasing the lift amount of the valve 104. The working angle of the valve 104 corresponds to a period (crank angle) during which the rocker roller 112 is positioned on the operating surface 152*a*. However, when the final contact position P3*f* moves toward the nonoperating surface 152*a*, the working angle of the valve 104 also decreases. Further, the first roller 170 moves in a direction opposite the rotation direction of the camshaft 120. Therefore, the contact position P1 at which the first roller 170 contacts the drive cam surface 124 when the camshaft 120 is at the same rotation position moves toward the advance side of the drive cam 122. This advances the swing timing of the swing cam arm 150 in relation to the phase of the camshaft 120. As a result, the valve timing (maximum lift timing) advances.

Figure 5:
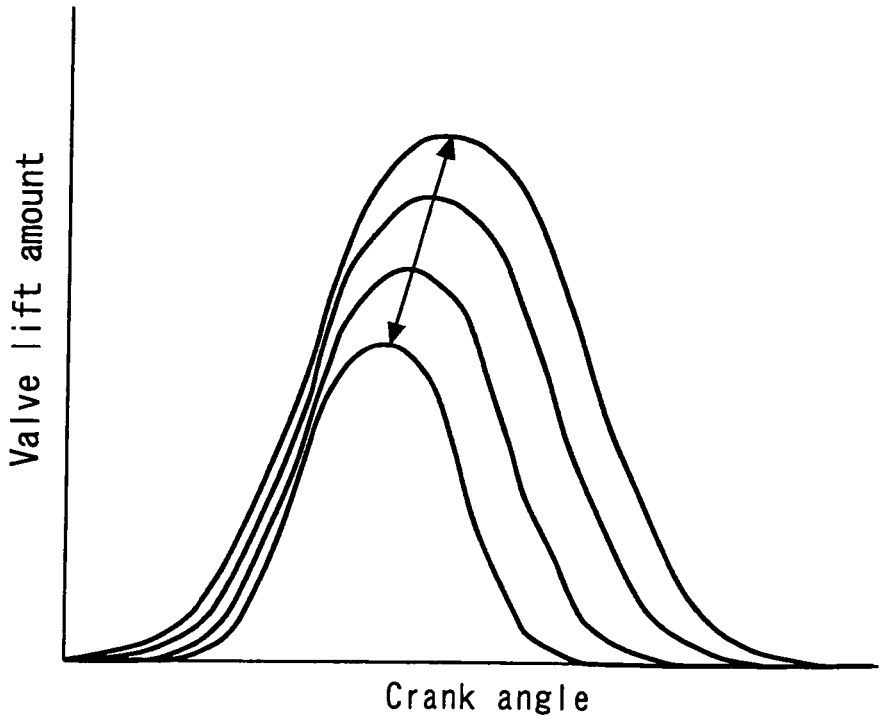
FIG. 5 is a graph showing the relationship between the valve lift amount and valve timing of the valve achieved by the variable valve operating device according to the first embodiment of the present invention.

FIG. 5 is a graph illustrating the relationship between the lift amount and valve timing of the valve 104, which are provided by the variable valve operating device 100. As shown in this figure, the variable valve operating device 100 increases the working angle and retards the valve timing when the lift amount of the valve 104 increases. Conversely, the variable valve operating device 100 decreases the working angle and advances the valve timing when the lift amount of the valve 104 decreases. Therefore, if the valve 104 is an intake valve, it is possible to vary the operating characteristic without using a VVT or other valve timing control mechanism so that the opening timing of the valve 104 remains virtually fixed.

[Advantages of the Variable Valve Operating Device According to the First Embodiment]

As described above, the variable valve operating device 100 according to the present embodiment rotates the control shaft 132 to change the rotation position of the first gear 134, thereby changing the contact position P2 at which the second rollers 164 contact the slide surface and the contact position P1 at which the first roller 162 contacts the drive cam surface 124. As a result, the variable valve operating device 100 according to the present embodiment can change the lift amount, working angle, and valve timing of the valve 104 in a coordinated manner.

Further, the control arm 160 is installed over the existing camshaft 120, and the control arm 160 supports the rollers 170, 172. Therefore, in marked contrast to a conventional structure in which the rollers are supported by the arm installed over the control shaft, the entire apparatus can be rendered compact. Furthermore, the influence upon the other members and apparatuses mounted inside the cylinder head can be minimized. In addition, since the rollers 170, 172 are concentrically positioned, the distance between the drive cam surface 124 and slide surface 156 is reduced. This also makes the entire apparatus compact.

Within the adjustment mechanism 130, which changes the aforementioned operating characteristic, only the intermediate members, such as the rollers 170, 172 and connecting member 174, and the swing cam arm 150 move to lift the valve 104. Therefore, when compared to a conventional valve apparatus that does not have the adjustment mechanism 130, the increase in the inertial mass of the entire movable section is suppressed. Therefore, the variable valve operating device 100 according to the present embodiment does not obstruct an increase in the internal combustion engine speed and suppresses the decrease in fuel efficiency.

Further, the guide 166 that supports the rollers 170, 172 is formed outward from the center of the camshaft 120. Therefore, the rollers 170, 172 reciprocate substantially in the radial direction of the camshaft 120 in accordance with the rotation of the drive cam 122. Unnecessary motions of the rollers 170, 172 on the slide surface 156 are then suppressed so as to minimize the loss in the driving force transmission from the drive cam 122 to the swing cam arm 150. This also suppresses the decrease in internal combustion engine fuel efficiency.

When the drive cam 122 rotates to lift the valve 104, the reactive force of the lost motion spring 190 and valve spring, not shown, is input from the slide surface 156 to the rollers 170, 172 so that the torque around the camshaft 120 works on the control arm 160, which supports the rollers 170, 172. Since the above-mentioned reactive force varies with the swing of the swing cam arm 150, the torque working on the control arm 160 also varies. When such torque variation is conversely input from the control arm 160 to the control shaft 132, the rotation position of the control shaft 132 changes unexpectedly. When the rotation position of the control shaft 132 changes unexpectedly, the contact positions P1, P2 at which the rollers 170, 172 contact the drive cam surface 124 or slide surface 156 also change unexpectedly. Consequently, a desired operating characteristic cannot be obtained.

In regard to the above matter, the gears 134, 162 in the variable valve operating device 100 according to the present embodiment, which interlocks the rotation of the control shaft 132 with that of the control arm 160, constitute a speed reducing mechanism. It is therefore possible to inhibit an inverse torque variation input from the control arm 160 to the control shaft 132 and avoid an unexpected change in the rotation position of the control shaft. It means that control can be exercised to vary the operating characteristic of the valve 104 with high accuracy.

Second Embodiment

A second embodiment of the present invention will now be described with reference to FIGS. 6 to 8.

[Configuration of a Variable Valve Operating Device According to the Second Embodiment]

Figure 6:
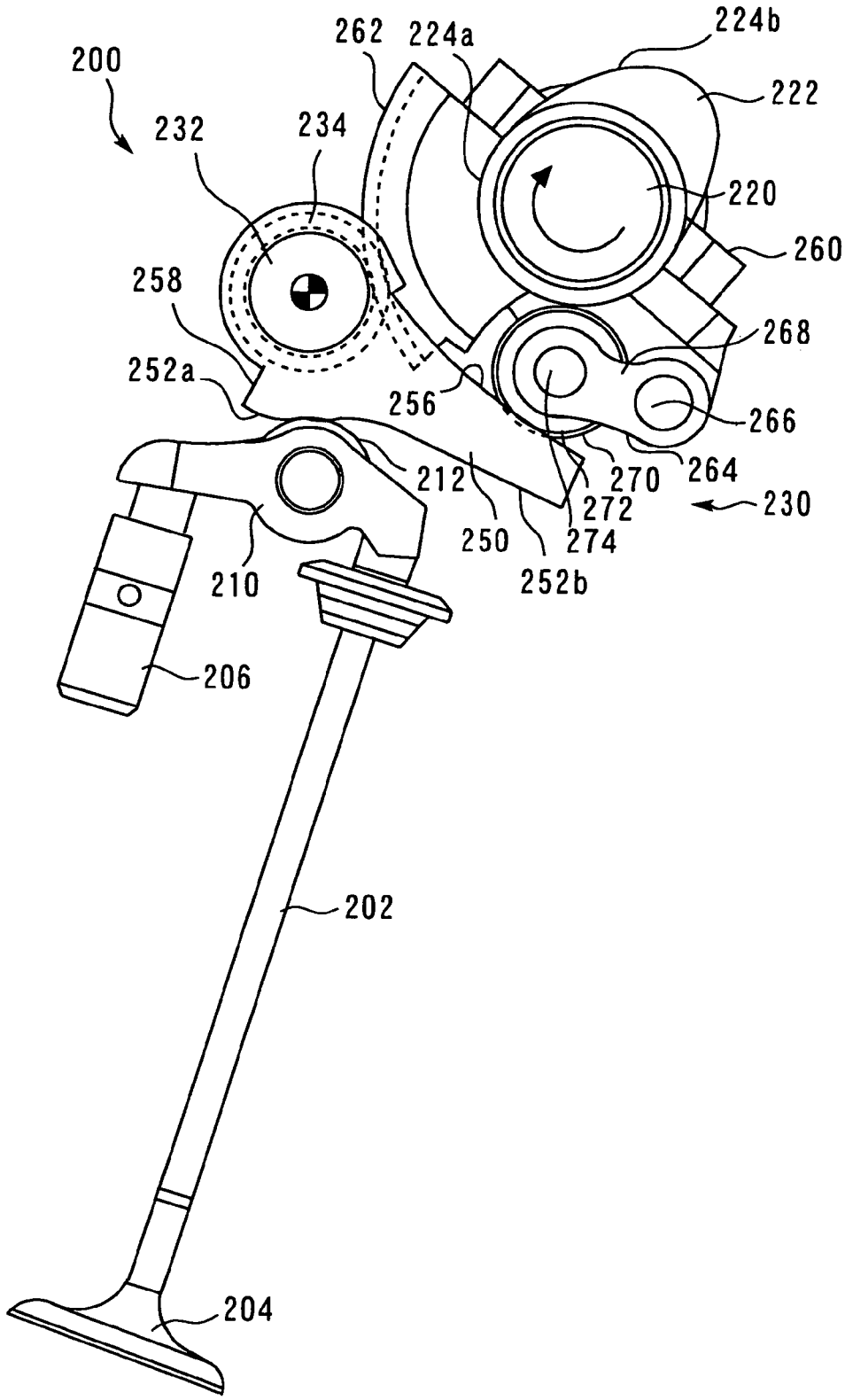
FIG. 6 is a side elevational view showing the configuration of a variable valve operating device according to the second embodiment of the present invention.

FIG. 6 is a side view illustrating the configuration of a variable valve operating device 200 according to the second embodiment of the present invention. The variable valve operating device 200 includes a rocker arm type mechanical valve mechanism. A drive cam 222, which is installed over a cam shaft 220, coverts the rotation motion of a camshaft 220 to the swing motion of a rocker arm (valve support member) 210 and to the vertical lift motion of a valve 204, which is supported by the rocker arm 210. The drive cam 222 has two cam surfaces 224*a*, 224*b*, which have different profiles. One cam surface, nonoperating surface 224*a*, is formed so that the distance from the center of the camshaft 220 is fixed in the rotation direction. The other cam surface, operating surface 224*b*, is formed so that the distance from the center of the camshaft 220 gradually increases and then gradually decreases after the apex in the rotation direction. In this document, the term "drive cam surface 224" is used when the nonoperating surface 224*a* and operating surface 224*b* are not distinguished from each other.

As is the case with the variable valve operating device according to the first embodiment, the variable valve operating device 200 according to the second embodiment includes an adjustment mechanism 230, which is positioned between the drive cam 222 and rocker arm 210 to interlock the swing motion of the rocker arm 210 with the rotation motion of the drive cam 222. As described below, the adjustment mechanism 230 mainly comprises a control shaft 232, a swing cam arm (swing member) 250, a control arm (control member) 260, a control link (link member) 264, a first roller 270, a second roller 272, and a connecting shaft 274, which connects the first roller 270 to the second roller 272. The control shaft 232 is parallel to the camshaft 220. The position of the control shaft 232 relative to the camshaft 220 is set downstream in the rotation direction of the camshaft 220 from the rocker arm 210. A first gear 234, which is concentric with the control shaft 232, is positioned on the outer circumferential surface of the control shaft 232 and fastened to the control shaft 232. Further, an actuator (e.g., motor), which is not shown, is connected to the control shaft 232. An ECU for an internal combustion engine can control the actuator to adjust the rotation position of the control shaft 232.

The swing cam arm 250 is supported by the control shaft 232 and allowed to swing. The leading end of the swing cam arm 250 is positioned upstream in the rotation direction of the drive cam 222. A slide surface 256 is formed on the side opposite the drive cam 222 for the swing cam arm 250. The slide surface 256 comes into contact with the second roller 272, which will be described later. The slide surface 256 is curved leniently toward the drive cam 222 and formed so that the distance to the cam base circle (nonoperating surface 224*a*) for the drive cam 222 increases with an increase in the distance from the center of the control shaft 232, which is the center of swinging.

Meanwhile, a swing cam surface 252 (252*a*, 252*b*) is formed on the side opposite the slide surface 256 of the swing cam arm 250. The swing cam surface 252 is a cam surface whose cam center coincides with the swing center of the swing cam arm 250, and composed of a nonoperating surface 252*a* and an operating surface 252*b*, which have different profiles. The nonoperating surface 252*a* is a circumferential surface of the cam base circle and formed at a fixed distance from the center of the control shaft 232. The other surface, which is the operating surface 252*b*, is positioned toward the leading end of the swing cam arm 250 as viewed from the nonoperating surface 252*a*, connected smoothly and contiguously to the nonoperating surface 252*a*, and formed so that the distance from the center of the control shaft 232 (that is, the cam height) gradually increases with a decrease in the distance to the leading end of the swing cam arm 250. In this document, the term "swing cam surface 252" is used when the nonoperating surface 252*a* and operating surface 252*b* are not distinguished from each other.

The variable valve operating device 200 employs a one-cam, two-valve drive structure in which one drive cam 222 drives two valves 204. Therefore, the swing cam arm 250 is positioned on both sides of the drive cam 222 (FIG. 6 shows only the front swing cam arm 250). The rocker arm 210 is provided for each swing cam arm 250. The swing cam surface 252 of the swing cam arm 250 is in contact with a rocker roller 212 for the rocker arm 210. The rocker roller 212 is mounted on the middle of the rocker arm 210 and allowed to rotate freely. One end of the rocker arm 210 is provided with a valve shaft 202, which supports the valve 204. The other end of the rocker arm 210 is supported by a hydraulic lash adjuster 206 and allowed to turn freely. A valve spring (not shown) presses the valve shaft 202 in the closing direction, that is, in the direction of pushing up the rocker arm 210. The rocker arm 210 is supported by the valve shaft 202, which is pressed by the valve spring. The hydraulic lash adjuster 206 presses the rocker roller 212 against the swing cam surface 252.

The swing cam arm 250 is provided with a spring seat 258 for engagement with a lost motion spring (not shown). The spring seat 258 is formed on the side opposite the operating surface 256*b* with respect to the nonoperating surface 252*a*. The lost motion spring is a compression spring. Its remaining end is secured by a stationary member (not shown). The spring force that the lost motion spring applies to the spring seat 258 presses the swing cam arm 250 to rotate it toward the slide surface 256.

The control arm 260 is supported by the camshaft 220 and allowed to rotate. The control arm 260 is provided with a second gear 262, which is wedge-shaped and formed around the rotation center of the control arm 260, that is, along an arc concentric with the camshaft 220. The position of the control arm 260 on the camshaft 220 is adjusted so that the second gear 262 is in the same plane as the first gear 234. Further, the rotation phase of the control arm 260 is adjusted so that the second gear 262 faces the first gear 234. The second gear 262 meshes with the first gear 234, and the rotation of the control shaft 232 is input to the control arm 260 via the first gear 234 and second gear 262. In other words, the first gear 234 and second gear 262 constitute a rotation interlock mechanism that interlocks the rotation of the control arm 260 with that of the control shaft 232. Further, the second gear 262 has a larger diameter than the first gear 234. Therefore, the first gear 234 and second gear 262 also constitute a speed reducing mechanism that decelerates the rotation of the control shaft 232 and transmits the decelerated rotation to the control arm 260.

The control arm 260 is provided with the control link 264. The control link 264 is mounted at a position away from the center of the camshaft 220, around which the control arm 260 turns, and is allowed to rotate freely. The end of the fulcrum side of the control link 264 is provided with a connection pin 266. The connection pin 266 is supported by the control arm 260 and allowed to rotate freely. The position of the connection pin 266 on the control arm 260 is virtually opposite the second gear 262 with respect to the turning center of the control arm 260. The leading end of the control link 264 is oriented toward the control shaft 232 while the connection pin 266 serves as a fulcrum. Each side of the drive cam 222 is provided with the control arm 260. The control link 264 is supported by the right- and left-hand control arms 160 (FIG. 6 excludes the front control arm 260).

The control link 264 has a pair of arms 268 (right- and left-hand arms). The right- and left-hand arms 268 support a connecting shaft 274 (FIG. 6 shows only the front arm 268). The connecting shaft 274 supports one first roller 270 and two second rollers 272, which are positioned on both sides of the first roller 270. The first and second rollers are allowed to rotate freely (FIG. 6 shows only the front second roller 272). The leading end of the control link 264 is oriented toward the control shaft 232 and in a direction opposite the extension direction of the swing cam arm 250. Both rollers 270, 272 are positioned between the drive cam surface 224 and slide surface 256. The first roller 270 is in contact with the drive cam surface 224. The second rollers 272 are in contact with the slide surface 256 of each swing cam arm 250. The force that the swing cam arm 250 receives from the lost motion spring causes the slide surface 256 to push up the second rollers 272. The first roller 270, which is concentric and integral with the second rollers 272, is pressed against the drive cam surface 224.

[Operations Performed by the Variable Valve Operating Device According to the Second Embodiment]

The operations performed by the variable valve operating device 200 will now be described with reference to FIGS. 7 and 8.

(1) Valve Lift Operation Performed by the Variable Valve Operating Device

First of all, the lift operation performed by the variable valve operating device 200 will be described with reference to FIG. 7. FIG. 7(A) shows the status of the variable valve operating device 200 that prevails when the valve 204 is closed in a valve lift operation sequence. FIG. 7(B) shows the status of the variable valve operating device 200 that prevails when the valve 204 is open in the valve lift operation sequence.

In the variable valve operating device 200, the rotation motion of the drive cam 222 is first input to the first roller 270, which comes into contact with the drive cam surface 224. The first roller 270 and the second rollers 272, which are concentric and integral with the first roller 270, swing around the pin 266. This swing motion is input to the slide surface 256 of the swing cam arm 250, which supports the second rollers 272. Since the force of the lost motion spring (not shown) constantly presses the slide surface 256 against the second rollers 272, the swing cam arm 250 swings around the control shaft 232 in accordance with the rotation of the drive cam 222.

Figure 7:
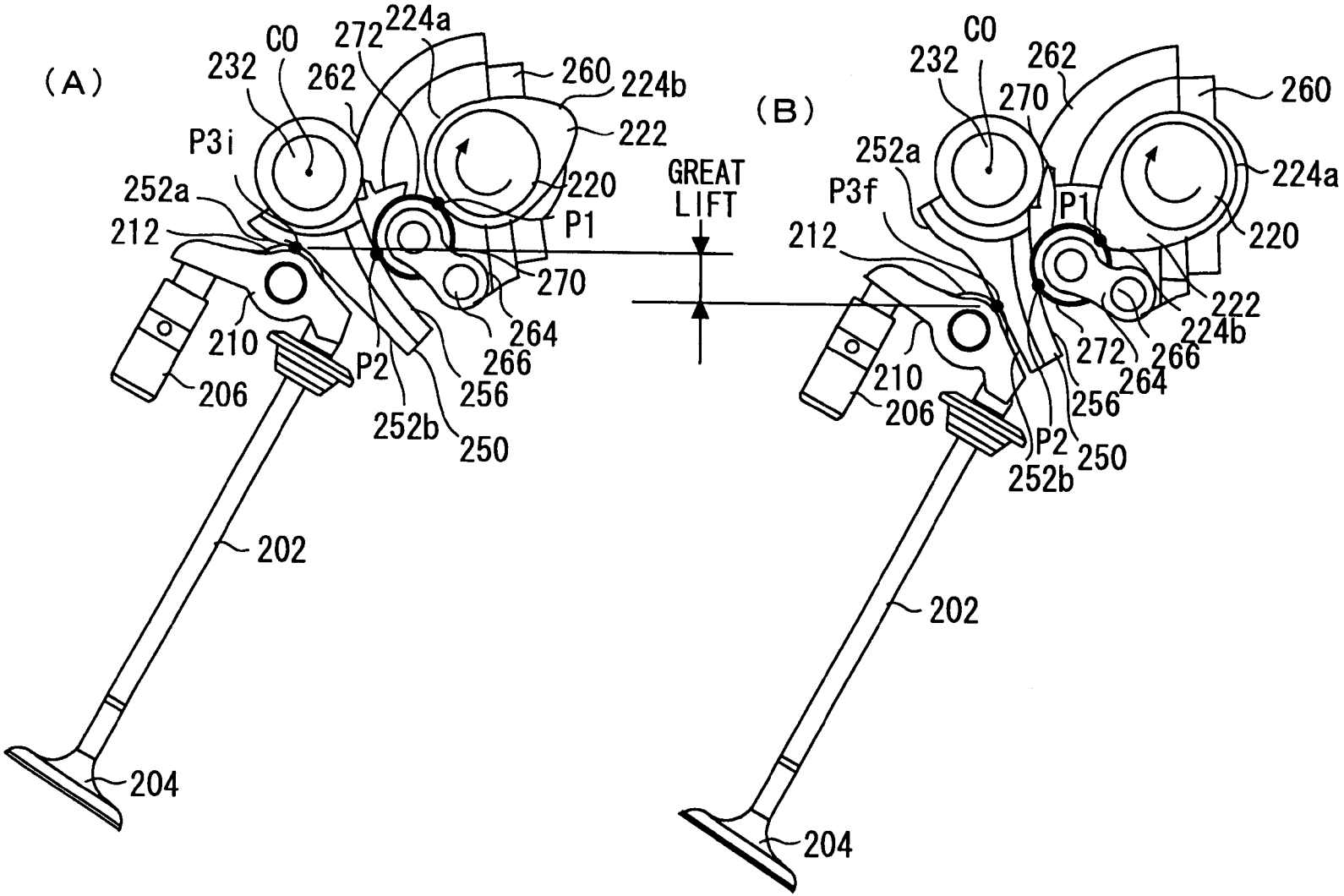
FIG. 7 illustrates a great lift operation performed by the variable valve operating device according to the second embodiment of the present invention, in the figure, (A) shows a valve open condition and (B) shows valve closed condition.
Figure 8:
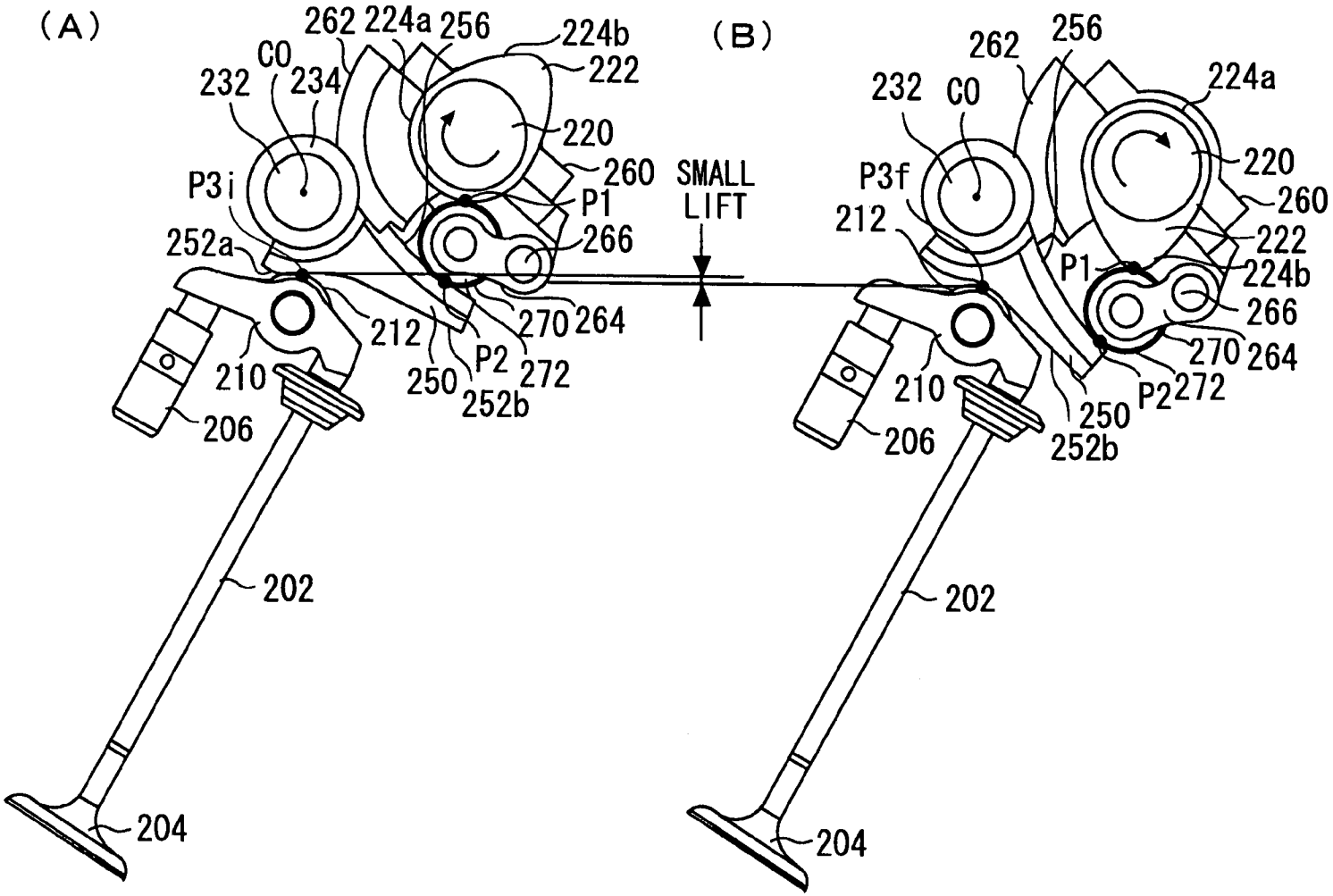
FIG. 8 illustrates a small lift operation performed by the variable valve operating device according to the second embodiment of the present invention, in the figure, (A) shows a valve open condition and (B) shows valve closed condition.

More specifically, when the camshaft 220 rotates in the state shown in FIG. 7(A), the contact position P1 at which the first roller 270 contacts the drive cam surface 224 changes from the nonoperating surface 224*a* to the operating surface 224*b* as indicated in FIG. 7(B). Relatively, the first roller 270 is pushed downward by the drive cam 222. Then, the first roller 270 moves together with the second rollers 272, which are concentric and integral with the first roller 270, along the locus defined by the control link 264. The second rollers 272 then push down the slide surface 256 of the swing cam arm 250. Consequently, the swing cam arm 250 turns clockwise around the control shaft 232 as indicated in FIG. 7. When the camshaft 220 further rotates until the contact position P1 at which the first roller 270 contacts the drive cam surface 224 passes the apex of the operating surface 224*b*, the force generated by the lost motion spring and valve spring causes the swing cam arm 250 to turn counterclockwise around the control shaft 232 as indicated in FIG. 7.

When the swing cam arm 250 turns around the control shaft 232 as described above, the contact position P3 at which the rocker roller 212 contacts the swing cam surface 252 changes. In FIG. 7, the contact positions at which the rocker roller 212 contacts the swing cam surface 252 are designated P3*i* and P3*f*. This is to distinguish between an initial contact position P3*i* and a final contact position P3*f*, which will be described later. In this document, the term "contact position P3" is simply used to represent the contact position at which the rocker roller 212 contacts the swing cam surface 252.

When the rocker roller 212 is in contact with the nonoperating surface 252*a* as indicated in FIG. 7(A), the distance between the nonoperating surface 252*a* and the center of the control shaft 232 is fixed. Therefore, the position of the rocker roller 212 within the space remains unchanged without regard to the contact position. Consequently, the rocker arm 210 does not swing so that the valve 204 is maintained at a fixed position. The positional relationship among the components of the variable valve operating device 200 is adjusted so as to close the valve 204 when the rocker roller 212 is in contact with the nonoperating surface 252*a*.

When the contact position P3 at which the rocker roller 212 contacts the swing cam surface 252 changes from the nonoperating surface 252*a* to the operating surface 252*b* as indicated in FIG. 7(B), the rocker arm 210 is pushed downward in accordance with the distance between the operating surface 252*b* and the center of the control shaft 232. This causes the rocker arm 210 to swing clockwise around a point that is supported by the hydraulic lash adjuster 106. The valve 204 is then pushed downward and opened by the rocker arm 210.

(2) Valve Lift Amount Change Operation Performed by the Variable Valve Operating Device The valve lift amount change operation performed by the variable valve operating device 200 will now be described with reference to FIGS. 7 and 8. FIG. 8 illustrates an operation in which the variable valve operating device 200 gives a small lift to the valve 204. Meanwhile, FIG. 7 illustrates an operation in which the variable valve operating device 200 gives a great lift to the valve 204. FIGS. 7(A) and 8(A) show the status of the variable valve operating device 200 that prevails when the valve 204 is closed in a valve lift operation sequence. FIGS. 7(B) and 8(B) show the status of the variable valve operating device 200 that prevails when the valve 204 is open in the valve lift operation sequence.

When the valve lift amount is to be changed from the valve lift amount shown in FIG. 7(B) to the valve lift amount shown in FIG. 8(B), the control shaft 232, which is in the state shown in FIG. 7(A), is rotated in the same direction as that of the rotation of the camshaft 220 (rotated clockwise as viewed in the figures), and the control arm 260 is rotated to the rotation position shown in FIG. 8(A). The rotation amount of the control arm 260 is determined by the rotation amount of the control shaft 232 and the gear ratio between the first gear 234 (see FIG. 1) and second gear 262. Both rollers 270, 272 are connected to the control arm 260 by means of the control link 264. Therefore, when the control arm 260 rotates, the first roller 270 moves in a direction opposite the rotation direction of the camshaft 220 along the drive cam surface 224, whereas the second rollers 272 move away from the control shaft 232 along the slide surface 256.

When the second rollers 272 move away from the control shaft 232, the distance between the swing center CO of the swing cam arm 250 and the contact position P2 at which the second rollers 272 contact the slide surface 256 increases, thereby decreasing the swing angle of the swing cam arm 250. The reason is that the swing angle of the swing cam arm 250 is in inverse proportion to the distance between the swing center CO and the contact position P2, which is an oscillation input point. As indicated in FIGS. 7(B) and 8(B), the lift of the valve 204 is maximized when the contact position P1 at which the first roller 270 contacts the drive cam surface 224 is at the apex of the operating surface 224*b*, and the lift amount of the valve 204 is determined by the contact position P3*f* at which the rocker roller 212 contacts the swing cam surface 252 when the valve lift is maximized (hereinafter referred to as the final contact position). As is the case with the first embodiment (see FIG. 4), the final contact position P3*f* is determined by the aforementioned swing angle of the swing cam arm 250 and the contact position P3*i* at which the rocker roller 212 contacts the swing cam surface 252 as indicated in FIGS. 7(A) and 8(A) (hereinafter referred to as the initial contact position).

In the variable valve operating device 200 according to the present embodiment, the slide surface 256 is formed so that the distance to the cam base circle (nonoperating surface 224*a*) of the drive cam 222 increases with an increase in the distance to the swing center. Therefore, when the aforementioned contact position P2 moves away from the swing center CO of the swing cam arm 250, the swing cam arm 250 inclines in such a direction that the slide surface 256 approaches the drive cam surface 224. The swing cam arm 250 then turns counterclockwise around the control shaft 232 as viewed in the figures. This causes the initial contact position P3*i* of the rocker roller 212 on the swing cam surface 252 to move away from the operating surface 252*b* as indicated in FIG. 8(A).

When the control shaft 232 rotates in the same direction as that of the camshaft 220, the swing angle of the swing cam arm 250 decreases and the initial contact position P3*i* moves away from the operating surface 252*b*. Consequently, the final contact position P3*f* that the rocker roller 212 can reach moves toward the nonoperating surface 252*a*, thereby decreasing the lift amount of the valve 204. The working angle of the valve 204 corresponds to a period (crank angle) during which the rocker roller 212 is positioned on the operating surface 252*a*. However, when the final contact position P3*f* moves toward the nonoperating surface 252*a*, the working angle of the valve 204 also decreases. Further, the first roller 270 moves in a direction opposite the rotation direction of the camshaft 220. Therefore, the contact position P1 at which the first roller 270 contacts the drive cam surface 224 when the camshaft 220 is at the same rotation position moves toward the advance side of the drive cam 222. This advances the swing timing of the swing cam arm 250 in relation to the phase of the camshaft 220. As a result, the valve timing (maximum lift timing) advances.

[Advantages of the Variable Valve Operating Device According to the Second Embodiment]

As described above, the variable valve operating device 200 according to the present embodiment changes the rotation position of the control shaft 232 to change the contact position P2 at which the second rollers 272 contact the slide surface 256 and the contact position P1 at which the first roller 270 contacts the drive cam surface 224, thereby changing the lift amount, working angle, and valve timing of the valve 204 in a coordinated manner. As is the case with the variable valve operating device 100 according to the first embodiment, the variable valve operating device 200 according to the present embodiment also provides a valve timing-lift characteristic shown in FIG. 5.

In the variable valve operating device 200 according to the present embodiment, the control arm 260 is installed over the existing camshaft 220 as is the case with the variable valve operating device according to the first embodiment. The control link 264 mounted on the control arm 260 supports the rollers 270, 272. Therefore, the entire apparatus can be rendered compact. Further, the influence upon the other members and apparatuses mounted inside the cylinder head can be minimized. Furthermore, since the rollers 270, 272 are concentrically positioned, the distance between the drive cam surface 224 and slide surface 256 is reduced as is the case with the first embodiment.

In the variable valve operating device 200 according to the present embodiment, the rollers 270, 272 are supported by the control link 264. However, when compared to a conventional structure that supports the rollers with an arm installed over the control shaft, the control link 264 for supporting the rollers 270, 272 near the camshaft 220 is shorter. Therefore, the variable valve operating device 200 according to the present embodiment can also avoid an increase in the inertial mass of the entire movable section when compared to the conventional structure.

In the variable valve operating device 200 according to the present embodiment, the gears 234, 264 for interlocking the rotation of the control shaft 232 with that of the control arm 260 constitute a speed reducing mechanism as is the case with the variable valve operating device according to the first embodiment. It is therefore possible to inhibit an inverse torque variation input from the control arm 260 to the control shaft 232 and avoid an unexpected change in the rotation position of the control shaft.

OTHER

While the present invention has been described in terms of preferred embodiments, it should be understood that the invention is not limited to the preferred embodiments, and that variations may be made without departure from the scope and spirit of the invention. For example, the following modifications may be made to the preferred embodiments of the present invention.

In the embodiments described above, the first gear 134, 234, which is fastened to the control shaft 132, 232 meshes with the second gear 162, 262, which is provided for the control arm 160, 260, to constitute the "rotation interlock mechanism" according to the first aspect of the present invention. However, one or a plurality of intermediate gears may alternatively be positioned between the first gear 134, 234 and second gear 162, 262. Another alternative is to use a worm gear as a gear mechanism. Still another alternative is to use a chain mechanism or belt mechanism as an interlock mechanism in addition to the gear mechanism.

In the embodiments described above, the present invention is applied to a rocker arm type valve apparatus. However, the present invention can also be applied to a direct acting or other valve apparatus.

The invention claimed is:

1. A variable valve operating device for mechanically changing the operating characteristic of a valve in relation to the rotation of a camshaft, the variable valve operating device comprising:

a drive cam that is installed over the camshaft;

a control shaft that is positioned in parallel with the camshaft and capable of changing the rotation position continuously or stepwise;

a swing member that is installed over the control shaft and allowed to swing around the control shaft;

a swing cam surface that is formed on the swing member, comes into contact with a valve support member, which supports the valve, and presses the valve in a lifting direction;

a slide surface that is formed on the swing member so as to face the drive cam;

an intermediate member that is positioned between the drive cam and the swing member and comes into contact with both the slide surface and a cam surface of the drive cam;

a control member that is installed over the camshaft and allowed to rotate;

a support member that is mounted on the control member to support the intermediate member so that the intermediate member can be moved along a predetermined path in relation to the control member; and a rotation interlock mechanism for interlocking the rotation of the control member around the camshaft with the rotation of the control shaft.

2. The variable valve operating device according to claim 1, wherein the support member is formed as a guide that is integral with the control member.

3. The variable valve operating device according to claim 2, wherein the guide is formed outward from the center of the camshaft.

4. The variable valve operating device according to claim 1, wherein the support member is configured as a link member for linking the control member to the intermediate member, mounted on the control member, and allowed to swing around a position away from the center of the camshaft.

5. The variable valve operating device according to claim 1, wherein the rotation interlock mechanism comprises a first gear, which is installed over the control shaft to rotate together with the control shaft, and a second gear, which is installed over the control member to mesh with the first gear.

6. The variable valve operating device according to claim 1, wherein the rotation interlock mechanism is a speed reducing mechanism for decelerating the rotation of the control shaft with gears and transmitting the decelerated rotation to the control member.

7. The variable valve operating device according to claim 1, wherein the swing cam surface includes a nonoperating surface, which is formed at a fixed distance from the swing center of the swing member, and an operating surface, which is contiguous with the nonoperating surface and whose distance to the swing center gradually increases with an increase in the distance to the nonoperating surface; and wherein the valve is lifted when the swing member swings so that the contact position at which the swing cam surface contacts the valve support member moves from the nonoperating surface to the operating surface.

8. The variable valve operating device according to claim 1, wherein the intermediate member includes a first roller, which comes into contact with the cam surface of the drive cam; a second roller, which is concentric with the first roller and comes into contact with the slide surface; and a connecting shaft, which connects the first roller to the second roller so as to permit the first and second rollers to rotate independently of each other.

* * * * *